US006779885B2

(12) United States Patent
Missell et al.

(10) Patent No.: US 6,779,885 B2
(45) Date of Patent: Aug. 24, 2004

(54) INK JET PRINTING METHOD

(75) Inventors: Gregory E. Missell, Penfield, NY (US); Jeanne E. Kaeding, Rochester, NY (US); Dennis E. Smith, Rochester, NY (US); Paul B. Merkel, Victor, NY (US)

(73) Assignee: Eastman Kodak Company, Rochester, NY (US)

( * ) Notice: Subject to any disclaimer, the term of this patent is extended or adjusted under 35 U.S.C. 154(b) by 147 days.

(21) Appl. No.: 10/011,655

(22) Filed: Dec. 4, 2001

(65) Prior Publication Data

US 2003/0103128 A1 Jun. 5, 2003

(51) Int. Cl.[7] ..... B41M 5/00; B41J 2/01

(52) U.S. Cl. ..... 347/105; 428/32.34; 428/32.36; 428/32.37

(58) Field of Search ..... 428/32.17, 32.34, 428/32.38, 32.1, 32.36, 32.37; 347/105

(56) References Cited

FOREIGN PATENT DOCUMENTS

| | | |
|---|---|---|
| EP | 0 704 314 A1 | 4/1996 |
| EP | 0 754 560 A1 | 1/1997 |
| EP | 0 802 245 A1 | 10/1997 |
| JP | 2000-203154 | 7/2000 |
| WO | 99/21723 | 5/1999 |

*Primary Examiner*—Pamela R. Schwartz
(74) *Attorney, Agent, or Firm*—Harold E. Cole; Chris P. Konkol

(57) ABSTRACT

An ink jet printing method having the steps of: A) providing an ink jet printer that is responsive to digital data signals; B) loading the printer with an ink jet recording element having a support having thereon an image-receiving layer of porous polymeric particles in a polymeric binder, the porous polymeric particles being prepared in the presence of an anionic or ationic dispersant, and the image-receiving layer containing a surfactant having a charge opposite to that of the dispersant used to make the porous polymeric particles, the surfactant being present in an amount from about 0.04 parts to about 0.30 parts by weight of the dispersant; C) loading the printer with an ink jet ink composition; and D) printing on the ink jet recording element using the ink jet ink composition in response to the digital data signals.

20 Claims, No Drawings

INK JET PRINTING METHOD

CROSS REFERENCE TO RELATED APPLICATION

Reference is made to commonly assigned, U.S. patent application Ser. No. 10/011,681 by Missell et al., filed of even date herewith, entitled "Ink Jet Recording Element", now U.S. Pat. No. 6,677,004.

FIELD OF THE INVENTION

This invention relates to an ink jet printing method using a porous ink jet recording element containing porous polymeric particles.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof an ink-receiving or image-forming layer, and includes those intended for reflection viewing, which have an opaque support, and those intended for viewing by transmitted light, which have a transparent support.

While a wide variety of different types of image-recording elements for use with ink jet devices have been proposed heretofore, there are many unsolved problems in the art and many deficiencies in the known products which have limited their commercial usefulness.

It is well known that in order to achieve and maintain photographic-quality images on such an image-recording element, an ink jet recording element must:

- Be readily wetted so there is no puddling, i.e., coalescence of adjacent ink dots, which leads to non-uniform density
- Exhibit no image bleeding
- Absorb high concentrations of ink and dry quickly to avoid elements blocking together when stacked against subsequent prints or other surfaces
- Exhibit no discontinuities or defects due to interactions between the support and/or layer(s), such as cracking, repellencies, comb lines and the like
- Not allow unabsorbed dyes to aggregate at the free surface causing dye crystallization, which results in bloom or bronzing effects in the imaged areas
- Have an optimized image fastness to avoid fade from contact with water or radiation by daylight, tungsten light, or fluorescent light An ink jet recording element that simultaneously provides an almost instantaneous ink dry time and good image quality is desirable. However, given the wide range of ink compositions and ink volumes that a recording element needs to accommodate, these requirements of ink jet recording media are difficult to achieve simultaneously.

Ink jet recording elements are known that employ porous or non-porous single layer or multilayer coatings that act as suitable image-receiving layers on one or both sides of a porous or non-porous support. Recording elements that use non-porous coatings typically have good image quality but exhibit poor ink dry time. Recording elements that use porous coatings exhibit superior dry times, but typically have poorer image quality and are prone to cracking.

A problem with known ink jet recording elements that employ a porous single layer or multilayer coatings that act as suitable image-receiving layer(s) is dye stability during storage. In particular, dyes printed onto an ink jet receiver element tend to fade due to exposure to ozone which is present in the atmosphere.

Another problem with ink jet recording elements that employ a porous single layer or multilayer coatings that act as suitable image-receiving layer(s0 is image stability under high humidity storage conditions. In particular, dyes tend to migrate through the image receiving layer during storage since the dye image receiving layer is hydrophilic and tends to absorb water from the atmosphere.

Japanese Kokai 2000-203154 relates to an ink jet recording sheet containing cationic porous particles in an ink recording layer. However, there is a problem with this element in that it the inks printed thereon have poor stability in the presence of ozone.

It is an object of this invention to provide an ink jet printing method using an ink jet recording element that has a fast ink dry time. It is another object of this invention to provide an ink jet printing method using an ink jet recording element that has good stability when exposed to ozone and high humidity conditions.

SUMMARY OF THE INVENTION

These and other objects are achieved in accordance with the invention which comprises an ink jet printing method comprising the steps of:

A) providing an ink jet printer that is responsive to digital data signals;

B) loading the printer with an ink jet recording element comprising a support having thereon an image-receiving layer comprising porous polymeric particles in a polymeric binder, the porous polymeric particles being prepared in the presence of an anionic or cationic dispersant, and the image-receiving layer containing a surfactant having a charge opposite to that of the dispersant used to make the porous polymeric particles, the surfactant being present in an amount from about 0.04 parts to about 0.30 parts by weight of the dispersant;

C) loading the printer with an ink jet ink composition; and

D) printing on the ink jet recording element using the ink jet ink composition in response to the digital data signals.

By use of the invention, an ink jet recording element is obtained which has a good dry time and good stability when exposed to ozone and high humidity conditions.

DETAILED DESCRIPTION OF THE INVENTION

The support used in the ink jet recording element employed in the printing method of the invention may be opaque, translucent, or transparent. There may be used, for example, plain papers, resin-coated papers, various plastics including a polyester resin such as poly(ethylene terephthalate), poly(ethylene naphthalate) and poly(ester diacetate), a polycarbonate resin, a fluorine resin such as poly(tetra-fluoro ethylene), metal foil, various glass materials, and the like. In a preferred embodiment, the support is paper or a voided plastic material. The thickness of the support employed in the invention can be from about 12 to about 500 μm, preferably from about 75 to about 300 μm.

The porous polymeric particles which are used in the invention are in the form of porous beads, porous irregularly shaped particles, or are aggregates of emulsion particles.

Suitable porous polymeric particles used in the invention comprise, for example, acrylic resins, styrenic resins, or cellulose derivatives, such as cellulose acetate, cellulose acetate butyrate, cellulose propionate, cellulose acetate propionate, and ethyl cellulose; polyvinyl resins such as polyvinyl chloride, copolymers of vinyl chloride and vinyl acetate and polyvinyl butyral, polyvinyl acetal, ethylene-vinyl acetate copolymers, ethylene-vinyl alcohol copolymers, and ethylene-allyl copolymers such as ethylene-allyl alcohol copolymers, ethylene-allyl acetone copolymers, ethylene-allyl benzene copolymers, ethylene-allyl ether copolymers, ethylene acrylic copolymers and polyoxy-methylene; polycondensation polymers, such as, polyesters, including polyethylene terephthalate, polybutylene terephthalate, polyurethanes and polycarbonates.

In a preferred embodiment of the invention, the porous polymeric particles are made from a styrenic or an acrylic monomer. Any suitable ethylenically unsaturated monomer or mixture of monomers may be used in making such styrenic or acrylic polymer. There may be used, for example, styrenic compounds, such as styrene, vinyl toluene, p-chlorostyrene, vinylbenzylchloride or vinyl naphthalene; or acrylic compounds, such as methyl acrylate, ethyl acrylate, n-butyl acrylate, n-octyl acrylate, 2-chloroethyl acrylate, phenyl acrylate, methyl-α-chloroacrylate, methyl methacrylate, ethyl methacrylate, butyl methacrylate; and mixtures thereof. In another preferred embodiment, methyl methacrylate or ethylene glycol dimethacrylate is used.

In a preferred embodiment of the invention, the porous polymeric particles are crosslinked. They may have a degree of crosslinking of about 27 mole % or greater, preferably about 50 mole %, and most preferably about 100 mole %. The degree of crosslinking is determined by the mole % of multifunctional crosslinking monomer which is incorporated into the porous polymeric particles.

Typical crosslinking monomers which may be used in making the porous polymeric particles employed in the invention are aromatic divinyl compounds such as divinylbenzene, divinylnaphthalene or derivatives thereof; diethylene carboxylate esters and amides such as ethylene glycol dimethacrylate, diethylene glycol diacrylate, and other divinyl compounds such as divinyl sulfide or divinyl sulfone compounds. Divinylbenzene and ethylene glycol dimethacrylate are especially preferred.

The porous polymeric particles used in this invention can be prepared, for example, by pulverizing and classification of porous organic compounds, by emulsion, suspension, and dispersion polymerization of organic monomers, by spray drying of a solution containing organic compounds, or by a polymer suspension technique which consists of dissolving an organic material in a water immiscible solvent, dispersing the solution as fine liquid droplets in aqueous solution, and removing the solvent by evaporation or other suitable techniques. The bulk, emulsion, dispersion, and suspension polymerization procedures are well known to those skilled in the polymer art and are taught in such textbooks as G. Odian in "Principles of Polymerization", 2nd Ed. Wiley (1981), and W. P. Sorenson and T. W. Campbell in "Preparation Method of Polymer Chemistry", 2nd Ed, Wiley (1968).

Techniques to synthesize porous polymer particles are taught, for example, in U.S. Pat. Nos. 5,840,293; 5,993,805; 5,403,870; and 5,599,889, and Japanese Kokai Hei 5[1993]-222108, the disclosures of which are hereby incorporated by reference. For example, an inert fluid or porogen may be mixed with the monomers used in making the porous polymer particles. After polymerization is complete, the resulting polymeric particles are, at this point, substantially porous because the polymer has formed around the porogen thereby forming the pore network. This technique is described more fully in U.S. Pat. No. 5,840,293 referred to above. Thus, the porosity of the porous polymeric particles is achieved by mixing a porogen with the monomers used to make the polymeric particles, dispersing the resultant mixture in water, and polymerizing the monomers to form the porous polymeric particles.

A preferred method of preparing the porous polymeric particles used in this invention includes forming a suspension or dispersion of ethylenically unsaturated monomer droplets containing the crosslinking monomer and a porogen in an aqueous medium, polymerizing the monomer to form solid, porous polymeric particles, and optionally removing the porogen by vacuum stripping. The particles thus prepared have a porosity as measured by a specific surface area of about 35 $m^2/g$ or greater, preferably 100 $m^2/g$ or greater. The surface area is usually measured by B.E.T. nitrogen analysis known to those skilled in the art.

The porous polymeric particles may be covered with a layer of colloidal inorganic particles as described in U.S. Pat. Nos. 5,288,598; 5,378,577; 5,563,226 and 5,750,378, the disclosures of which are incorporated herein by reference. The porous polymeric particles may also be covered with a layer of colloidal polymer latex particles as described in U.S. Pat. No. 5,279,934, the disclosure of which is incorporated herein by reference.

The porous polymeric particles used in this invention have a median diameter less than about 10 μm, preferably less than about 1 μm, and most preferably less than about 0.6 μm. Median diameter is defined as the statistical average of the measured particle size distribution on a volume basis. For further details concerning median diameter measurement, see T. Allen, "Particle Size Measurement", 4th Ed., Chapman and Hall, (1990).

As noted above, the polymeric particles used in the invention are porous. By porous is meant particles which either have voids or are permeable to liquids. These particles can have either a smooth or a rough surface.

As noted above, the porous polymeric particles are prepared in the presence of a dispersant. Suitable dispersants include anionic dispersants such as aliphatic carboxylic acid salts, including lithium, sodium, potassium, and ammonium salts, abietic acid salts, hydroxyalkane-sulfonic acid salts, alkanesulfonic acid salts (Triton X-200®), alpha-olefin sulfonates (Rhodacal A246®), dialkylsulfosuccinic acid salts such as the sodium salt of dioctyl 2-sulfosuccinic acid (Aerosol OT®), straight-chained alkylbenzenesulfonic acid salts and branched alkylbenzenesulfonic acid salts such as dodecylbenzene-sulfonic acid sodium salt (SDBS), alkylnaphthalene sulfonic acid salts (Alkanol XC®), disodium salts of the alkyl half-esters of sulfosuccinic acids, disodium salts of the ethoxylated alkyl half-ester of sulfosuccinic acids, and other salts of alkyl and arylalkyl derivatives of sulfosuccinic acids, alkylphenoxy-polyoxyethylene propylsulfonic acid salts, polyoxyethylenealkylsulfophenyl ether salts, salts of N-methyl-N-oleyltaurine, such as sodium N-methyl-N-oleyltaurine (OMT), N-alkylsulfosuccinic acid monoamide disodium salts, petroleum sulfonates, salts of alkyl sulfates such as sodium dodecylsulfate, sulfated castor oil, sulfated tallow, sulfate ester salts of aliphatic acid alkyl esters, alkyl sulfate ester salts, polyoxyethylene alkylether sulfate ester salts, aliphatic acid monoglyceride sulfate ester salts, polyoxyethylene alkylphenylether sulfate ester salts, polyoxyethylene styrylphenylether sulfate ester salts, sodium and potasium salts of mono- and di-alkyl phosphate esters, polyoxyethylene alkylether phosphate ester salts, polyoxyethylene alkylphenylether phosphate ester salts, partially saponified styrene-maleic anhydride copolymers, partially saponified olefin-maleic anhydride copolymers, and naphthalenesulfonic acid salts condensed with formaldehyde. In a preferred embodiment of the invention, the anionic dispersant is sodium dodecylbenzenesulfonate, sodium dodecylsulfate, the sodium salt of N-oleyl-N-methyltaurine, or the dioctyl ester of sodium sulfosuccinic acid. The counter ions of all these anionic salts can be lithium, sodium, potassium, ammonium, or other positively charged ions.

Cationic dispersants may also be used in this invention and include, for example, alkylamine salts, the counter ions of which can be halides, sulfonates, phosphates, sulfates, etc., alkyl and benzyl quaternary ammonium salts, such as N-Alkyl(C12–C16)-N,N-dimethyl-N-benzyl ammonium chloride [where Alkyl (C12–C16) means a mixture of alkyl groups having from 12 to 16 carbon atoms] and cetyltrimethylammonium chloride, polyoxyethylene-alkylamine salts, polyethylenealkylquaternary ammonium salts, polyethylenepolyamine derivatives, alkyl pyridinium salts, such as hexadecylpyridinium chloride; alkyl imidazolium salts, and other alkyl substituted aromatic cyclic amine salts, alkyl and aromatic phosphonium salts. The counter ions of all these cationic salts can be halides, sulfonates, phosphates, sulfates, nitrates, acetates, etc.

As noted above, the image-receiving layer contains a surfactant. Any known anionic or cationic surfactant can be employed, such as those same materials listed above as the anionic or cationic dispersant, provided it has a charge opposite to that of the dispersant used to make the porous polymeric particles and is employed in the amount as stated above.

The polymeric binder used in the invention may comprise a poly(vinyl alcohol), a gelatin, a cellulose ether, polyvinylpyrrolidone, poly(ethylene oxide), etc. The image-receiving layer may also contain additives such as pH-modifiers like nitric acid, cross-linkers, rheology modifiers, surfactants, UV-absorbers, biocides, lubricants, water-dispersible latexes, mordants, dyes, optical brighteners etc.

The image-receiving layer may be applied to one or both substrate surfaces through conventional pre-metered or post-metered coating methods such as blade, air knife, rod, roll, slot die, curtain, slide, etc. The choice of coating process would be determined from the economics of the operation and in turn, would determine the formulation specifications such as coating solids, coating viscosity, and coating speed.

The image-receiving layer thickness may range from about 5 to about 100 $\mu$m, preferably from about 10 to about 50 $\mu$m. The coating thickness required is determined through the need for the coating to act as a sump for absorption of ink solvent. The image-receiving layer of this invention contains from about 0.20 to about 10.0 g/m$^2$ of polymeric binder, preferably from about 0.40 to about 5.0 g/m$^2$, and about 1.5 to about 60 g/m$^2$ of porous polymeric particles, preferably from about 3.0 to about 30 g/m$^2$.

Ink jet inks used to image the recording elements employed in the printing method of the invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such composition have been typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

The following example further illustrates the invention.

EXAMPLE

Synthesis of Porous Polymeric Particles

Preparation 1—Synthesis of Porous Polymeric Particles with a Cationic Surfactant To a beaker were added the following ingredients: 260 g ethylene glycol dimethacrylate as monomer, 132 g toluene as a porogen, 8 g hexadecane, and 3.9 g 2,2'-azobis(2,4-dimethylvaleronitrile), Vazo 52® (DuPont Corp.). The ingredients were stirred until all the solids were dissolved.

To this solution was added a mixture of 21.6 g N-Alkyl (C12–C16)-N,N-dimethyl-N-benzyl ammonium chloride (Barquat MB-50®, from Lonza Inc.) in 1200 g distilled water. The mixture was then stirred with a marine prop type agitator for 5 minutes to form a crude emulsion. The crude emulsion was passed once through a Crepaco® homogenizer at 420 kg/cm$^2$. The resulting monomer droplet dispersion was placed into a 2-liter three-necked round bottom flask. The flask was placed in a 50° C. constant temperature bath and the dispersion stirred at 130 rev./min. under positive pressure nitrogen for 16 hours to polymerize the monomer droplets into porous polymeric particles. The product was filtered through a coarse filter to remove coagulum. Next, 4 drops of MAZU® antifoam agent (BASF Corp.) was added and toluene and some water were distilled off under vacuum at 70° C. to give 20.8% solids. The porous polymeric particles were measured by a particle size analyzer, Horiba LA-920®, and found to be 0.17 $\mu$m in median diameter. A dried portion of the dispersion, analyzed by B.E.T. Multipoint using a Quantachrome Corp., NOVA 1000® analyzer had a specific surface area of 218 m$^2$/g.

Preparation 2—Synthesis of Porous Polymeric Particles with an Anionic Surfactant This preparation was prepared the same as Preparation 1 except that a mixture of 12 g sodium dodecylbenzenesulfonate (SDBS) in 1200 g distilled water was added to the monomer mixture, and the Barquat MB-50® was omitted. The final dispersion was found to be 22.1% solids. The porous polymeric particles were measured by a particle size analyzer, Horiba LA-920®, and found to be 0.16 $\mu$m in median diameter. A dried portion of the dispersion, analyzed by B.E.T. Multipoint using a Quantachrome Corp., NOVA 1000® analyzer had a specific surface area of 224 m$^2$/g.

Preparation 3—Synthesis of Porous Polymeric Particles with an Anionic Surfactant This preparation was prepared the same as Preparation 2 except that a mixture of 21.6 g sodium dodecylsulfate (SDS), instead of the SDBS, in 1200 g distilled water was added to the monomer mixture. The final dispersion was found to be 23.7% solids. The porous polymeric particles were measured by a particle size analyzer, Horiba LA-920®, and found to be 0.16 μm in median diameter.

Preparation 4—Synthesis of Porous Polymeric Particles with an Anionic Surfactant This preparation was prepared the same as Preparation 2 except that a mixture of 21.6 g sodium salt of N-oleyl-N-methyltaurine (OMT), instead of the SDBS, in 1200 g distilled water was added to the monomer mixture. The final dispersion was found to be 25.5% solids. The porous polymeric particles were measured by a particle size analyzer, Horiba LA-920®, and found to be 0.18 μm in median diameter.

Preparation 5—Synthesis of Porous Polymeric Particles with an Anionic Surfactant This preparation was prepared the same as Preparation 2 except that 21.6 g dioctyl ester of sodium sulfosuccinic acid (Aerosol OT-100) was added to the monomer and the SDBS was omitted. In addition, the crude emulsion was passed twice through Gaulin homogenizer 225 kg/cm$^2$ instead of a Crepaco® homogenizer at 420 kg/cm$^2$. The porous polymeric particles were measured by a particle size analyzer, Horiba LA-920®, and found to be 0.14 μm in median diameter. A dried portion of the dispersion, analyzed by B.E.T. Multipoint using a Quantachrome Corp., NOVA 1000® analyzer had a specific surface area of 187 m$^2$/g.

Preparation of Coating Solutions

Coating solutions CS-1 through CS-35 were prepared by mixing together the porous polymeric particles of Preparations 1 to 5 with a binder of poly(vinyl alcohol) using Gohsenol AH-22® (Gohsen Nippon of Japan) and the surfactants listed in Table 1 below. The amount of surfactant listed in Table 1 is parts per weight (ppw) relative to the dispersant used in Preparations 1–5. The resulting coating solution were 15% solids and 85% water, with the solids being 85% porous polymeric particles and 15% poly(vinyl alcohol). The solutions were stirred at 40° C. for approximately 30 minutes before coating. The coating solutions were visually evaluated for agglomeration. Agglomerated solutions were uncoatable.

TABLE 1

| Coating | | Surfactant | | |
|---|---|---|---|---|
| Solution | Preparation | Type | Amount (ppw) | Agglomeration |
| CS-1 | 1 | None | | No |
| CS-2 | 1 | SDS | 0.03 | No |
| CS-3 | 1 | SDS | 0.08 | No |
| CS-4 | 1 | SDS | 0.30 | No |
| CS-5 | 1 | SDS | 0.38 | Yes |
| CS-6 | 1 | None | | No |
| CS-7 | 1 | OMT | 0.03 | No |
| CS-8 | 1 | OMT | 0.08 | No |
| CS-9 | 1 | OMT | 0.30 | No |
| CS-10 | 1 | OMT | 0.38 | Yes |
| CS-11 | 1 | None | | No |
| CS-12 | 1 | SDBS | 0.03 | No |
| CS-13 | 1 | SDBS | 0.08 | No |
| CS-14 | 1 | SDBS | 0.30 | No |
| CS-15 | 1 | SDBS | 0.38 | Yes |
| CS-16 | 2 | None | | No |
| CS-17 | 2 | Barquat ® | 0.03 | No |
| CS-18 | 2 | Barquat ® | 0.05 | No |
| CS-19 | 2 | Barquat ® | 0.21 | No |
| CS-20 | 2 | Barquat ® | 0.32 | Yes |
| CS-21 | 3 | None | | No |
| CS-22 | 3 | Barquat ® | 0.03 | No |
| CS-23 | 3 | Barquat ® | 0.05 | No |
| CS-24 | 3 | Barquat ® | 0.19 | No |
| CS-25 | 3 | Barquat ® | 0.32 | Yes |
| CS-26 | 4 | None | | No |
| CS-27 | 4 | Barquat ® | 0.02 | No |
| CS-28 | 4 | Barquat ® | 0.05 | No |
| CS-29 | 4 | Barquat ® | 0.21 | No |
| CS-30 | 4 | Barquat ® | 0.31 | Yes |
| CS-31 | 5 | None | | No |
| CS-32 | 5 | Barquat ® | 0.02 | No |
| CS-33 | 5 | Barquat ® | 0.04 | No |
| CS-34 | 5 | Barquat ® | 0.20 | No |
| CS-35 | 5 | Barquat ® | 0.31 | Yes |

The above results show that coating solutions with more than 0.30 parts of a surfactant having a charge opposite to that of the dispersant used to make the porous polymeric particles have unacceptable agglomeration and are unacceptable for coating.

Preparation of Elements

Elements 1–28 were made using the acceptable coating solutions listed in Table 1. They were coated, using a metered blade, on corona discharge-treated, photographic grade, polyethylene-coated paper, that was pre-coated with a 350 mg/ft$^2$ dry total lay down of a polyester (AQ29® from Eastman Chemical Company) and Borax at a 50:50 ratio, to a wet lay down of 120 μm, and oven dried for 30 minutes at 40° C. These elements were coated to a dry thickness of about 18 μm.

High Humidity Keeping Test

A series of lines for each color, (cyan, magenta, yellow, black, red, green, blue) were printed on the above elements using an Epson 870 Printer and Color Cartridge No. T008 and Black Cartridge No. T007 and allowed to dry for 2 hours. The width of each line was measured using a microscope. The printed elements were then placed in a chamber at 22° C. and 80% relative humidity. After 7 days, the elements were removed and the width of each line was remeasured. The largest change of any color was used to determine the change of that element. The elements were then rated according to the scale in Table 2 and results are listed in Table 3:

TABLE 2

| Rating | Change in Line Width |
|---|---|
| 1 | 0% to 5% |
| 2 | 6% to 10% |
| 3 | 11% to 15% |
| 4 | 16% to 20% |
| 5 | 21% and greater |

Ratings 1 and 2 are acceptable while ratings 3 to 5 are unacceptable.

Ozone Fade Test

A series of cyan density patches of a high-humectant Direct Blue 199 ink formulation were printed with a Hewlett Packard Desk Jet 695C printer. Status A red densities of each cyan patch were read using an X-RITE 338 reflection densitometer. The elements were then exposed to an atmosphere containing approximately 60 parts per billion of ozone under ambient fluorescent lighting (about 0.1 Klux) for four weeks. Ozone levels were maintained with a KLEEN AIR King II Model 1004 ultraviolet ozone generator. The red densities were reread and fade percentages were calculated, with less than 5% being acceptable. The results are listed in Table 3.

TABLE 3

| Element | Coating Solution | Ozone Fade Test (%) | High Humidity Keeping Test |
|---|---|---|---|
| Element 1 (Comparison) | CS-1 | 9.8 | 1 |
| Element 2 (Comparison) | CS-2 | 7.2 | 1 |
| Element 3 (Invention) | CS-3 | 2.7 | 1 |
| Element 4 (Invention) | CS-4 | 2.1 | 1 |
| Element 5 (Comparison) | CS-6 | 9.8 | 1 |
| Element 6 (Comparison) | CS-7 | 6.4 | 1 |
| Element 7 (Invention) | CS-8 | 2.1 | 1 |
| Element 8 (Invention) | CS-9 | 1.9 | 1 |
| Element 9 (Comparison) | CS-11 | 9.8 | 1 |
| Element 10 (Comparison) | CS-12 | 6.7 | 1 |
| Element 11 (Invention) | CS-13 | 2.6 | 1 |
| Element 12 (Invention) | CS-14 | 2.1 | 1 |
| Element 13 (Comparison) | CS-16 | 0.7 | 4 |
| Element 14 (Comparison) | CS-17 | 0.9 | 3 |
| Element 15 (Invention) | CS-18 | 1.9 | 2 |
| Element 16 (Invention) | CS-19 | 2.1 | 2 |
| Element 17 (Comparison) | CS-21 | 1.7 | 4 |
| Element 18 (Comparison) | CS-22 | 1.7 | 4 |
| Element 19 (Invention) | CS-23 | 1.4 | 2 |
| Element 20 (Invention) | CS-24 | 1.5 | 2 |
| Element 21 (Comparison) | CS-26 | 2.4 | 4 |
| Element 22 (Comparison) | CS-27 | 1.4 | 3 |
| Element 23 (Invention) | CS-28 | 0.7 | 2 |
| Element 24 (Invention) | CS-29 | 0.8 | 2 |
| Element 25 (Comparison) | CS-31 | 0.0 | 4 |
| Element 26 (Comparison) | CS-32 | 1.3 | 4 |
| Element 27 (Invention) | CS-33 | 1.4 | 2 |
| Element 28 (Invention) | CS-34 | 2.3 | 2 |

The above results show that ink jet receivers made with a surfactant having a charge opposite to that of the dispersant used to make the porous polymeric particles and in an amount from about 0.04 to about 0.30 parts by weight of the dispersant present during preparation of the porous polymeric particles, have both acceptable high humidity keeping and acceptable ozone fade.

This invention has been described with particular reference to preferred embodiments thereof but it will be understood that modifications can be made within the spirit and scope of the invention.

What is claimed is:

1. An ink jet printing method comprising the steps of:

A) providing an ink jet printer that is responsive to digital data signals;

B) loading said printer with an ink jet recording element comprising a support having thereon an image-receiving layer comprising porous polymeric particles in a polymeric binder, said porous polymeric particles being prepared in the presence of an anionic or cationic dispersant, and said image-receiving layer containing a surfactant having a charge opposite to that of said dispersant used to make said porous polymeric particles, said surfactant being present in an amount from about 0.04 parts to about 0.30 parts by weight of said dispersant;

C) loading said printer with an ink jet ink composition; and

D) printing on said ink jet recording element using said ink jet ink composition in response to said digital data signals.

2. The ink jet printing method of claim 1 wherein said porous polymeric particles have a median diameter of less than about 10 $\mu$m.

3. The ink jet printing method of claim 1 wherein said porous polymeric particles are crosslinked and have a degree of crosslinking of about 27 mole % or greater.

4. The ink jet printing method of claim 1 wherein said porous polymeric particles are made from a styrenic or an acrylic monomer.

5. The ink jet printing method of claim 4 wherein said acrylic monomer comprises methyl methacrylate or ethylene glycol dimethacrylate.

6. The ink jet printing method of claim 1 wherein said polymeric binder comprises a poly(vinyl alcohol), a gelatin, a cellulose ether, poly(vinyl pyrrolidone) or poly(ethylene oxide).

7. The ink jet printing method of claim 1 wherein said support is paper or a voided plastic material.

8. The ink jet printing method of claim 1 wherein the porosity of said porous polymeric particles is achieved by mixing a porogen with the monomers used to make said polymeric particles, dispersing the resultant mixture in water, and polymerizing said monomers to form said porous polymeric particles.

9. The ink jet printing method of claim 1 wherein said porous polymeric particles have a surface area of at least 35 $m^2/g$.

10. The ink jet printing method of claim 1 wherein said porous polymeric particles have a surface area of at least 100 $m^2/g$.

11. The ink jet printing method of claim 1 wherein said polymeric particles are prepared in the presence of an anionic dispersant.

12. The ink jet printing method of claim 11 wherein said anionic dispersant is sodium dodecylbenzenesulfonate, sodium dodecylsulfate, the sodium salt of N-oleyl-N-methyltaurine, or the dioctyl ester of sodium sulfosuccinic acid.

13. The ink jet printing method of claim 1 wherein said polymeric particles are prepared in the presence of an cationic dispersant.

14. The ink jet printing method of claim 13 wherein said cationic dispersant is N-Alkyl(C12–C16)-N,N-dimethyl-N-benzyl ammonium chloride.

15. The ink jet printing method of claim 1 wherein said surfactant is anionic.

16. The ink jet printing method of claim 15 wherein said anionic surfactant is sodium dodecylbenzenesulfonate, sodium dodecylsulfate, the sodium salt of N-oleyl-N-methyltaurine, or the dioctyl ester of sodium sulfosuccinic acid.

17. The ink jet printing method of claim 1 wherein said surfactant is cationic.

18. The ink jet printing method of claim 17 wherein said cationic surfactant is N-Alkyl(C12–C16)-N,N-dimethyl-N-benzyl ammonium chloride.

19. The ink jet printing method of claim 1 wherein said image-receiving layer contains from about 0.20 to about 10.0 $g/m^2$ of said polymeric binder and from about 1.5 to about 60 $g/m^2$ of said porous polymeric particles.

20. The ink jet printing method of claim 1 wherein said image-receiving layer contains from about 0.40 to about 5.0 $g/m^2$ of said polymeric binder and from about 3.0 to about 30 $g/m^2$ of said porous polymeric particles.

* * * * *